US007743469B2

(12) United States Patent
Saeger et al.

(10) Patent No.: US 7,743,469 B2
(45) **Date of Patent: *Jun. 29, 2010**

(54) APPARATUS ON A TEXTILE MACHINE FOR CLEANING FIBRE MATERIAL, FOR EXAMPLE OF COTTON, COMPRISING A HIGH-SPEED FIRST OR MAIN ROLLER

(75) Inventors: Nicole Saeger, Aachen (DE); Roland Friedrich, Schwalmtal (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 733 days.

This patent is subject to a terminal disclaimer.

(21) Appl. No.: 11/652,621

(22) Filed: Jan. 12, 2007

(65) Prior Publication Data

US 2007/0180660 A1 Aug. 9, 2007

(30) Foreign Application Priority Data

Feb. 3, 2006 (DE) ..... 10 2006 005 390

(51) Int. Cl.
*D01G 15/04* (2006.01)

(52) U.S. Cl. ..... 19/101

(58) Field of Classification Search ..... 19/100, 19/101, 105, 106 R

See application file for complete search history.

(56) References Cited

U.S. PATENT DOCUMENTS

| | | | | | |
|---|---|---|---|---|---|
| 1,567,841 | A | * | 12/1925 | Curtin | 19/100 |
| 4,712,276 | A | * | 12/1987 | Krusche | 19/99 |
| 4,843,685 | A | * | 7/1989 | Vesa et al. | 19/98 |
| 6,035,493 | A | * | 3/2000 | Carlton | 19/98 |
| 6,185,789 | B1 | | 2/2001 | Hollingsworth et al. | |
| 2004/0154137 | A1 | | 8/2004 | Bauersachs | |
| 2006/0156516 | A1 | | 7/2006 | Bocht | |

(Continued)

FOREIGN PATENT DOCUMENTS

| | | |
|---|---|---|
| DE | 25 39 603 B2 | 10/1976 |

(Continued)

OTHER PUBLICATIONS

German Search Report dated Aug. 17, 2006, issued in Application No. 10 2006 005 391.5.

(Continued)

*Primary Examiner*—Shaun R Hurley
(74) *Attorney, Agent, or Firm*—Venable LLP; Robert Kinberg; Steven J. Schwarz

(57) ABSTRACT

An apparatus on a textile machine for cleaning fiber material has a first roller for conveying a travelling fiber web, and second and third rollers which have respective nips with one another and with the first roller on rotation of the three rollers. The second roller is arranged downstream of the third roller and co-operates with the first roller so that fiber is detached, the fiber is transferred to the nip with the third roller and conveyed by the third roller to the nip with the first roller. The rollers have clothing with tips which are inclined in the direction of rotation. To improve the cleaning the front angle α of the tips of the second roller is about from 10° to 50° and the clothing gaps may be large to obtain a higher filling volume for fibers.

16 Claims, 4 Drawing Sheets

U.S. PATENT DOCUMENTS

| | | | | |
|---|---|---|---|---|
| 2007/0180658 | A1* | 8/2007 | Saeger et al. | 19/98 |
| 2007/0180659 | A1* | 8/2007 | Saeger et al. | 19/98 |

FOREIGN PATENT DOCUMENTS

| | | | |
|---|---|---|---|
| DE | 195 21 778 | A1 | 1/1997 |
| DE | 101 08 140 | A1 | 8/2002 |
| DE | 101 39 163 | A1 | 4/2003 |
| DE | 103 14 009 | A1 | 10/2004 |
| DE | 41 30 147 | B4 | 8/2005 |
| DE | 601 13 531 | T2 | 6/2006 |
| EP | 0 608 686 | A1 | 8/1994 |
| EP | 1290252 | | 9/2005 |
| GB | 841609 | | 7/1960 |
| GB | 1229556 | | 4/1971 |
| GB | 1287311 | | 8/1972 |
| GB | 1304765 | | 1/1973 |
| GB | 2258471 | | 2/1993 |
| WO | WO-01/92614 | A1 | 12/2001 |
| WO | WO-03/087446 | A3 | 10/2003 |
| WO | WO 2005/087994 | A1 | 9/2005 |

OTHER PUBLICATIONS

United Kingdom Search Report dated May 22, 2007, issued in GB0701953.2.

German Search Report dated Aug. 11, 2006, issued in Application No. 10 2006 005 389.3.

United Kingdom Search Report dated May 22, 2007, issued in Application No. GB 0701957.3.

United Kingdom Search Report dated May 22, 2007, issued in GB0701954.0.

German Search Report dated Aug. 11, 2006, issued in GB 10 2006 005 390.7.

* cited by examiner

APPARATUS ON A TEXTILE MACHINE FOR CLEANING FIBRE MATERIAL, FOR EXAMPLE OF COTTON, COMPRISING A HIGH-SPEED FIRST OR MAIN ROLLER

CROSS REFERENCE TO RELATED APPLICATION

This application claims priority from German Patent Application No. 10 2006 005 390.7 dated Feb. 3, 2006, the entire disclosure of which is incorporated herein by reference.

BACKGROUND OF THE INVENTION

The invention relates to an apparatus on a textile machine, for example a flat card, roller card or the like, for cleaning fibre material, for example of cotton.

There is described in WO 01/92614 (also published as EP 1 290 252 B) a carding machine comprising a high-speed first or main roller, which is so adapted that it supports or conveys a travelling fibre web, associated second and third rollers, which have respective nips with one another and with the first roller on rotation of the three rollers, and drive means for rotation of the rollers, which drive means are so arranged that the second roller is rotated in a direction of rotation that is the same as that of the first roller and opposite to that of the third roller, wherein the second roller is arranged downstream of the third roller and so co-operates with the first roller that a fibre mat is opened and detached, the fibre mat is transferred to the nip with the third roller and is conveyed by the third roller to the nip with the first roller, where it is transferred back to the first roller, the rollers having a clothing with needles or teeth which are inclined at an acute angle (front angle) in the direction of rotation, and in the region of the transition of the fibres from the first roller to the second roller the needles or teeth of the rollers in question being inclined in different directions and the speed of the second roller being low in comparison with the speed of the first roller.

In that known apparatus (EP 1 290 252 B1), the second roller (inverter) has on its cylindrical surface a wire clothing comprising needles or teeth that are inclined at an angle of less than 90° to the surface in question. As a result, the fibres are intended to be held so that they can be drawn through the nip with the first roller. The wire clothing has fine teeth, so that the fibres are able to penetrate only unsatisfactorily into the bottom of the clothing.

SUMMARY OF THE INVENTION

It is an aim of the invention to provide an apparatus in which the degree of cleaning is considerably increased.

The invention provides an apparatus on a textile machine for cleaning fibre material, wherein the apparatus comprises:

a first rotating roller arranged to convey a travelling fibre web;

a second rotating roller co-operating with the first roller to form a first nip, the second roller rotating more slowly than the first roller;

a third rotating roller co-operating with the second roller to form a second nip and with the first roller to form a third nip, the second roller being downstream of the third roller; and a drive arrangement arranged to rotate at least one of the second and third rollers in the opposite direction to the direction of rotation of the first roller;

the arrangement being such that fibre material is opened and detached by the second roller at the first nip, and the detached fibre material is conveyed by the second roller to the second nip and is conveyed by the third roller to the third nip, where it is transferred back to the first roller; and the rollers having a clothing with clothing tips, the front surfaces of which are inclined at an acute angle in the direction of rotation, the clothing tips of the first and second rollers being inclined in different directions in the region of the first nip and the angle of inclination of the clothing tips of the second roller being about from 10° to 50°.

According to the invention, the front angle of the teeth is particularly aggressive so as to promote separation of trash. That front angle results in the fibre's being retained in the cleaning zone, which facilitates a high degree of cleaning. Furthermore, the fibres, as a result of being held in the aggressive clothing, are pressed deep into the bottom of the clothing (tooth gaps), thus avoiding high loss of fibre and accordingly a high white content in the waste. A particular advantage is that the waste has a high black content, for example 90%. The cleaned fibre material improves further processing, for example in respect of a low number of thread breakages and higher yarn quality.

The clothing tips may be, for example, in the form of teeth or needles. The first roller, the second roller and the third roller may have a clothing on their cylindrical outer surface, the tips of which are advantageously inclined in the direction of rotation. In one embodiment of the invention, on transition of the fibres from the second roller to the third roller the tips of the rollers are inclined in the same direction. Suitable dimensions of the second and third rollers may vary, for example, according to the diameter of the first roller. In one exemplary embodiment, the diameter of the second roller may be about from 50 to 140 mm, whilst the diameter of the third roller may be about from 60 to 90 mm. Suitable rotational speeds for the second and third rollers may be selected having regard to the speed of rotation of the first roller. By way of example, the second roller may have a rotational speed of about from 0.5 to 2 rev/min and/or the third roller may have a rotational speed of about from 5 to 15 rev/min. It is preferred for the circumferential speed of the second roller to be low in comparison with the first roller. In one embodiment, the circumferential speed of the third roller is higher than the speed of the second roller but lower than the speed of the first roller. If desired, a separation opening having a width of about from 40 to 50 mm may be arranged downstream—seen in the direction of rotation of the first roller—of the second roller. Where present, the separation opening advantageously has a separating knife or the like, and/or may be associated with a suction device, for example a suction hood, for trash or the like. In a preferred embodiment, the clothing gaps, that is, the gaps between adjacent tips, are large. That allows a higher filling volume of fibres on the roller. In one embodiment, the volume that can become filled by fibres comprises the region between the free ends of the tips and the bottom of the tips. In another embodiment, the volume that can become filled by fibres consists essentially of the space between the tips of the clothing and the foot of the clothing. In one advantageous embodiment, the point density of the clothing on the second roller is low, for example, less than or equal to 140 ppsi.

In one preferred embodiment, the front angle is about from 40 to 50°. The clothing height may be, for example, about from 4 to 5 mm. The clothings may be of any suitable material or materials. Advantageously, at least some of the clothings are all-steel clothings. Advantageously, at least some of the clothings are flexible clothings. The apparatus of the invention may be used at any fibre-transporting roller at which cleaning of fibre is carried out. Advantageously, the first roller is the or a licker-in of a flat card or roller card. In a case of a licker-in group consisting of three lickers-in arranged one after the other, the first roller is advantageously the licker-in arranged in the middle.

In a further embodiment of the invention, the first roller is a carding cylinder and the second roller is a worker roller, and the direction of rotation of the second roller is opposed to the direction of rotation of the first roller and the same as the direction of rotation of the third roller.

The invention also provides an apparatus on a flat card, roller card or the like for cleaning fibre material, for example of cotton, comprising a high-speed first or main roller, which is adapted to support or convey a travelling fibre web, associated second and third rollers, which have respective nips with one another and with the first roller on rotation of the three rollers, and drive means for rotation of the rollers, which drive means are so arranged that the second roller is rotated in a direction of rotation that is the same as that of the first roller and opposite to that of the third roller, wherein the second roller is arranged downstream of the third roller and so co-operates with the first roller that a fibre mat is opened and detached, the fibre mat is transferred to the nip with the third roller and is conveyed by the third roller to the nip with the first roller, where it is transferred back to the first roller, the rollers having a clothing with needles or teeth which are inclined at an acute angle (front angle) in the direction of rotation, and in the region of the transition of the fibres from the first roller to the second roller the needles or teeth of the rollers in question being inclined in different directions and the speed of the second roller being low in comparison with the speed of the first roller, wherein the front angle of the teeth of the second roller is about from 10° to 50° and the clothing gaps are large to obtain a higher filling volume for fibres.

In another embodiment, the invention provides an apparatus on a flat card, roller card or the like for cleaning fibre material, for example cotton, comprising a high-speed cylinder which is adapted to support or convey a travelling fibre web, associated second and third rollers, which have respective nips with one another and with the cylinder on rotation of the rollers, and drive means for rotation of the rollers, wherein the second roller is arranged downstream of the third roller and so co-operates with the cylinder that a fibre mat is opened and detached, the fibre mat is transferred to the nip with the third roller and is conveyed by the third roller to the nip with the cylinder, where it is transferred back to the cylinder, the rollers having a clothing with needles or teeth which are inclined at an acute angle (front angle) in the direction of rotation, and in the region of the transition of the fibres from the cylinder to the second roller the needles or teeth of the rollers in question being inclined in different directions and the speed of the second roller being low in comparison with the speed of the cylinder, wherein the second roller is a worker roller and is rotated in a direction of rotation which is opposite to that of the cylinder and the same as that of the third roller. Advantageously, the front angle of the teeth of the worker roller is about from 10 to 50° and the clothing gaps are large to obtain a higher filling volume for fibres. Advantageously, upstream of a pair consisting of a worker roller and an inverter roller—seen in the direction of rotation of the cylinder—there is arranged at least one fixed carding element in which the teeth of the clothing are inclined opposite to the direction of rotation of the cylinder. Advantageously, between the edge of the separating knife and the nip of the cylinder with the worker roller there is a separation opening having a width of about from 40 to 60 mm.

DETAILED DESCRIPTION OF PREFERRED EMBODIMENTS

Figure 1:
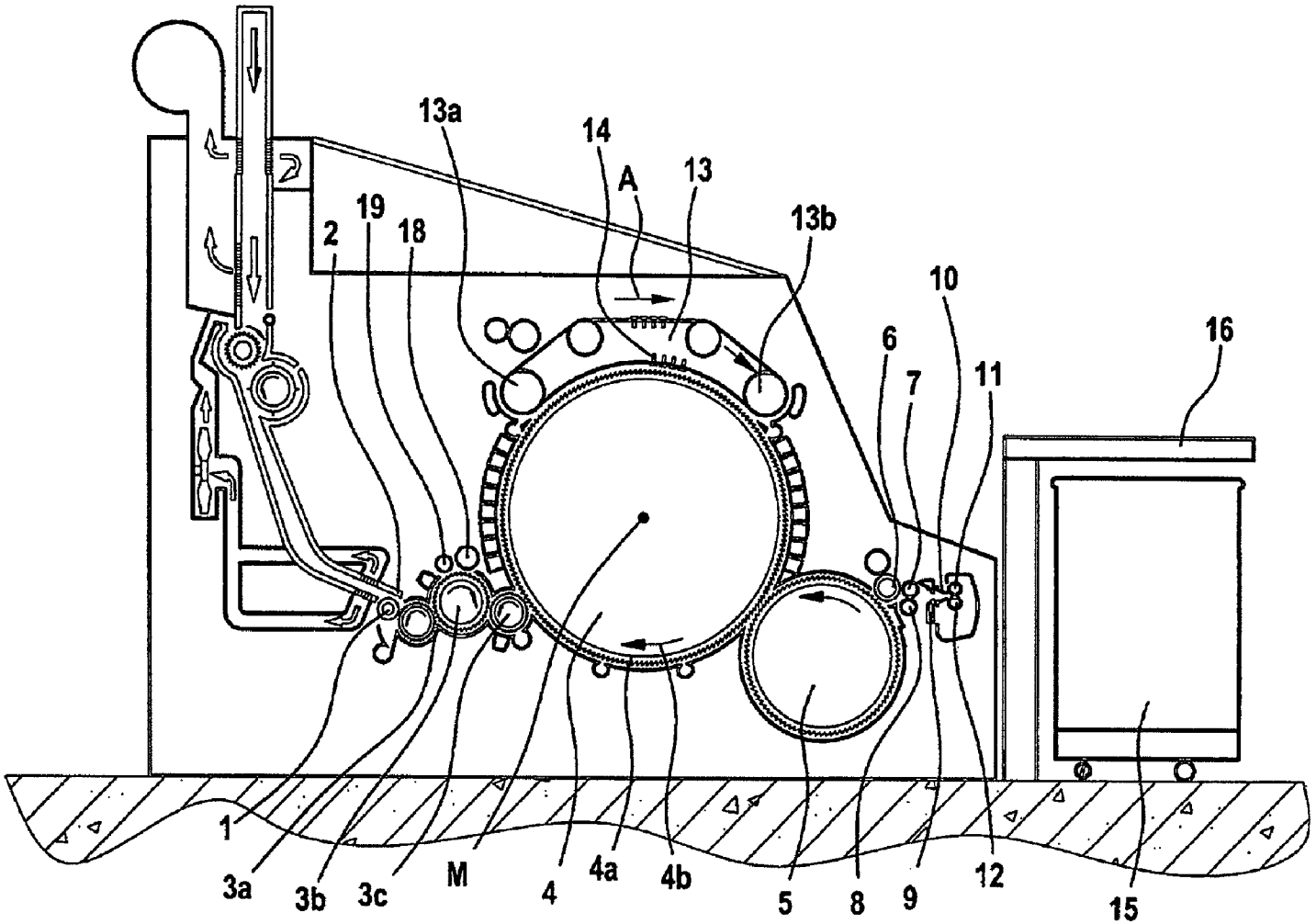
FIG. 1 is a diagrammatic side view of a flat card having an apparatus according to a first embodiment of the invention.

With reference to FIG. 1, a flat card, e.g. a TC 03 flat card made by Trützschler GmbH & Co. KG of Mönchengladbach, Germany, has a feed roller 1, feed table 2, lickers-in 3*a*, 3*b*, 3*c*, cylinder 4, doffer 5, stripper roller 6, nip rollers 7, 8, web guide element 9, web funnel 10, delivery rollers 11, 12, revolving card top 13 with card top guide rollers 13*a*, 13*b* and flats 14, can 15 and can coiler 16. The directions of rotation of the rollers are indicated by curved arrows. Reference letter M denotes the centre point (axis) of the cylinder 4. Reference numeral 4*a* indicates the clothing and reference numeral 4*b* indicates the direction of rotation of the cylinder 4. Arrow A indicates the working direction. The curved arrows shown inside the rollers indicate the directions of rotation of the rollers. A first embodiment of the invention is provided at the licker-in 3*b* at which there is a cleaning device 17 comprising a first roller 18 (inverter) and a second roller 19 (stripper) which are associated with the licker-in 3*b*.

Figure 2:
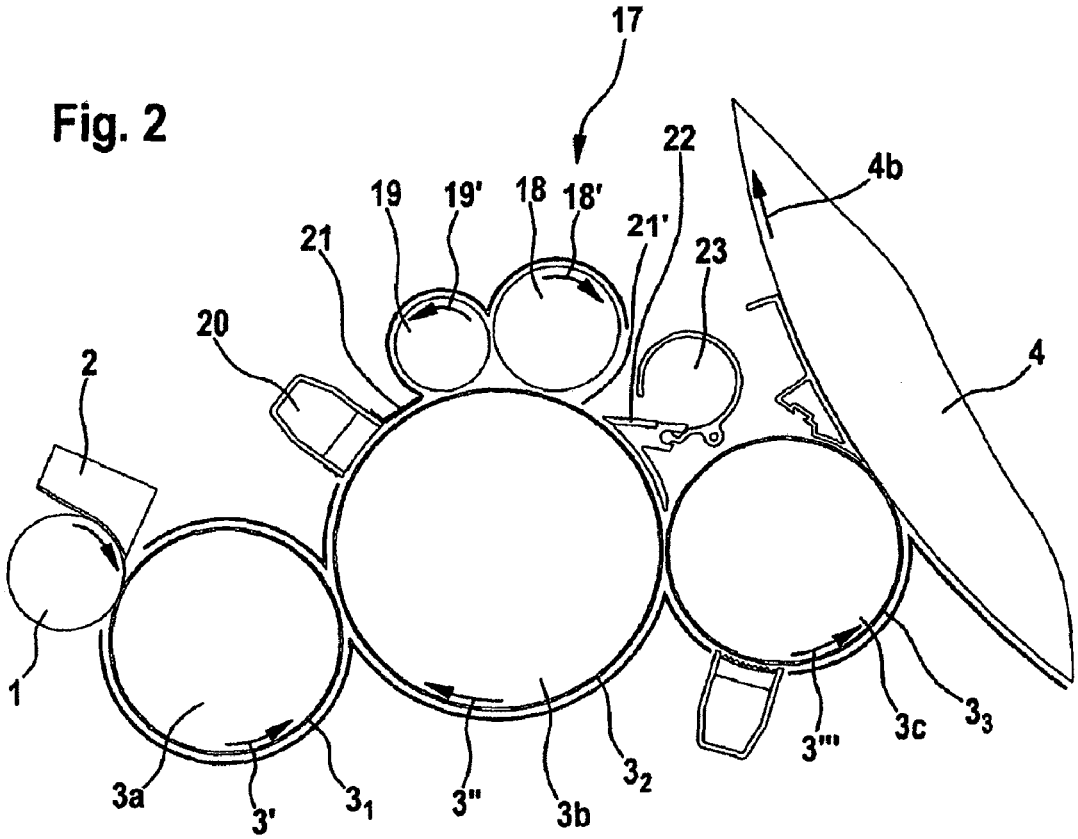
FIG. 2 is a side view of a portion of the flat card according to FIG. 1 in detail, the middle licker-in being associated with the apparatus according to the invention, which in the embodiment shown comprises two cleaning rollers and a trash-separating device.

Referring to FIG. 2, the lickers-in 3*a*, 3*b* and 3*c* of the machine of FIG. 1 are arranged one after the other in working direction A. Typical, but non-limiting, dimensions of the rollers are as follows: the first licker-in 3*a* may have a diameter $d_1$=172.5 mm and a circumferential speed $U_1$=10 m/sec, the second (middle) licker-in 3*b* may have a diameter $d_2$=250.0 mm and a circumferential speed $U_2$=15.8 m/sec, and the third licker-in may have a diameter $d_3$=172.5 mm and a circumferential speed $U_3$=21.0 m/sec. On the cylindrical outer surface of the lickers-in 3*a*, 3*b*, 3*c* there are arranged saw-tooth clothings $\mathbf{3}_1$, $\mathbf{3}_2$, $\mathbf{3}_3$ (all-steel clothings), the teeth of which are inclined in the working direction 3', 3", 3'" of the respective licker-in 3*a*, 3*b*, 3*c* (see FIG. 3 for clothing $\mathbf{3}_2$). In the upper circumferential region of the middle licker-in 3*b* there are arranged in succession—seen in the direction of rotation 3"—a fixed carding element 20, a cover element 21, the third roller 19, the second roller 18 and a separation opening 21' for trash and the like. The separation opening 21', which may have a width of for example 40 to 60 mm, and preferably 40 to 50 mm, is subjected to suction by a suction hood 23. A separating edge, comprising separating blade 22, is provided at the downstream limit of the opening 21'. The fixed carding element may, for example, be of the kind shown in FIG. 5. In the embodiment of FIG. 2, the high-speed first roller is the licker-in 3*b* which supports or conveys a travelling fibre web. The associated second roller 18 and the third roller 19 form a nip 24 with one another, and the first roller 3*b* forms a nip 25 with the second roller 18 and a nip 26 with the third roller 19. The rollers 3*b*, 18 and 19 are so driven by drive devices (not shown), for example drive motors, that the first roller 3*b* (direction of rotation 3") and the second roller 18 (direction of rotation 18') both rotate clockwise, while the third roller 19 (direction of rotation 19') rotates anti-clockwise. The second roller 18 is arranged downstream of the third roller 19.

Figure 3:
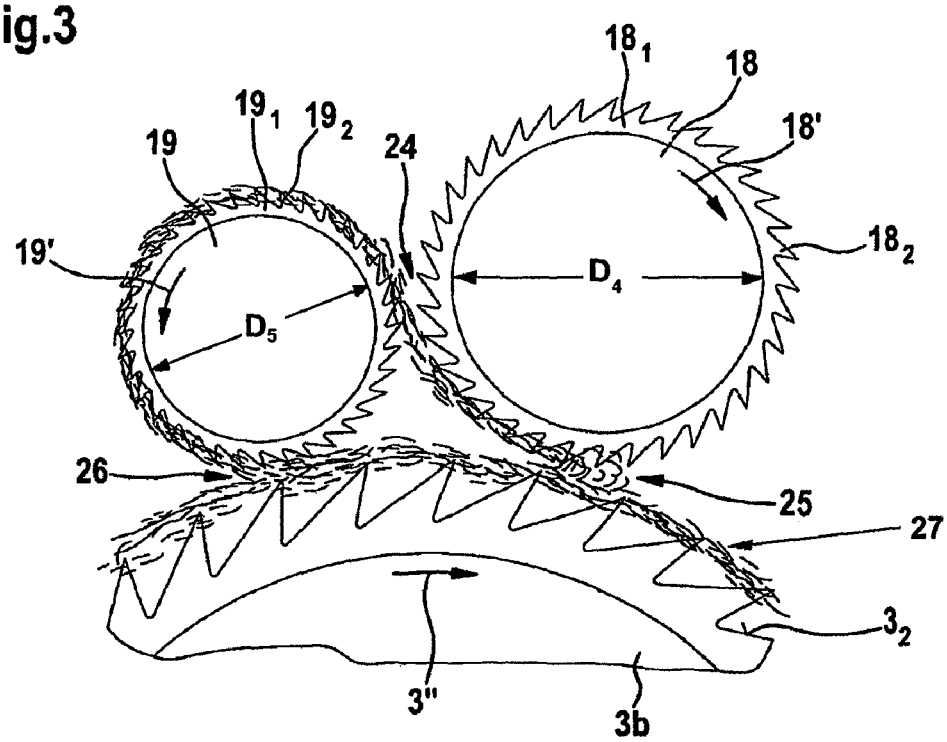
FIG. 3 is a diagrammatic view of the two cleaning rollers of the apparatus of FIG. 2 showing the path of movement of the fibre material.

As shown in FIG. 3, the second roller 18 co-operates with the first roller 3*b* so that a fibre layer 27 on the first roller 3*b* is opened and detached, the fibre layer 27 is transferred to the nip 24 with the third roller 19 and conveyed by the third roller 19 to the nip 26 with the first roller 3*b*, where it is transferred back to the first roller 3*b*. The rollers 18 and 19 have clothing $\mathbf{18}_1$, $\mathbf{19}_1$ with teeth $\mathbf{18}_2$, $\mathbf{19}_2$ which are inclined at an acute angle (front angle) in the direction of rotation 18', 19'. In the region of the transition of the fibre coating 27 from the first roller 3*b* to the second roller 18, the teeth of the clothings $\mathbf{3}_2$, $\mathbf{18}_1$ of the respective rollers 3*b*, 18 are inclined in different directions. In the embodiment shown in FIG. 3, the second roller 18 has a diameter $d_4$ of 100.0 mm and a rotational speed of 1 m/min, that is to say the circumferential speed of the second roller 18 is low in comparison with the circumferential speed of the first roller 3*b*. The third roller 19, in the exemplary embodiment shown in FIG. 3, has a diameter $d_5$ of 75.0 mm and a rotational speed of 10 m/min.

Figure 4A:
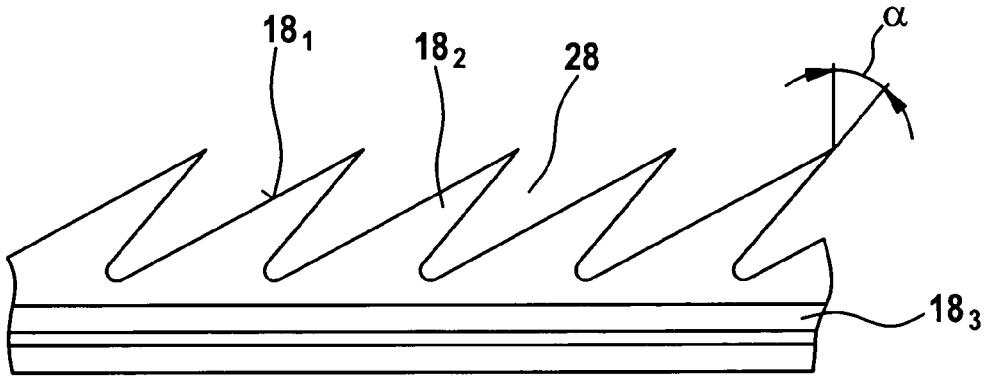
FIG. 4*a*, 4*b* are a side view (4*a*) and a front view in section (4*b*) of the clothing of the second roller (inverter) of the apparatus of FIG. 2.
Figure 4B:
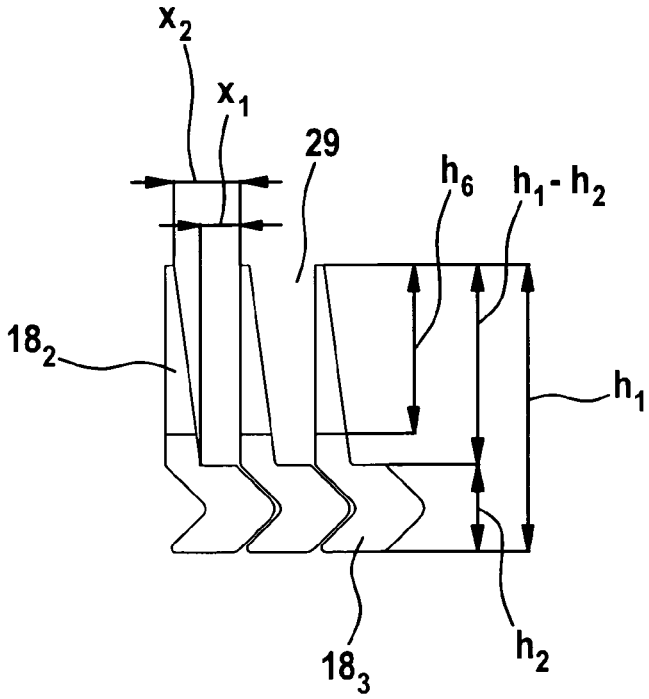

In accordance with FIG. 4*a*, the teeth $\mathbf{18}_2$ of the clothing 18, of the second roller 18 have a front angle $\alpha$=40°. The front angle (working angle) is, at $\alpha$=40°, aggressive and promotes the separation of trash at the separation opening 21' (see FIG. 2). The lower the point density per square inch (ppsi), the lower is the tendency of the clothing $\mathbf{18}_1$ in the case of the second roller 18 to become clogged with trash. The point density of the clothing $\mathbf{18}_1$ is advantageously less than equal to 140 ppsi. In accordance with FIG. 4*b:*

- $h_1$=overall height of the wire (for example from 4 to 5 mm) (distance from the base to the point of the wire)
- $h_2$=foot height (height of the foot $\mathbf{18}_3$ measured from the base)
- $h_1$-$h_2$=height from the point of the wire to the bottom of the clothing
- $h_6$=tooth depth (depth of the tooth gap cut-out, measured from the point of the tooth)
- $x_1$=distance between adjacent teeth $\mathbf{18}_2$ at the bottom of the tooth gap
- $x_2$=distance between adjacent teeth $\mathbf{18}_2$ at the points of the teeth
- $\alpha$=front angle (angle between the front face and the vertical axis relative to the wire base)

Reference numeral 28 indicates the clothing gaps between teeth $\mathbf{18}_2$ located one after the other in the direction in which the clothing extends and reference numeral 29 indicates the clothing gaps between teeth $\mathbf{18}_2$ located one next to the other on adjacent clothing portions.

Figure 5:
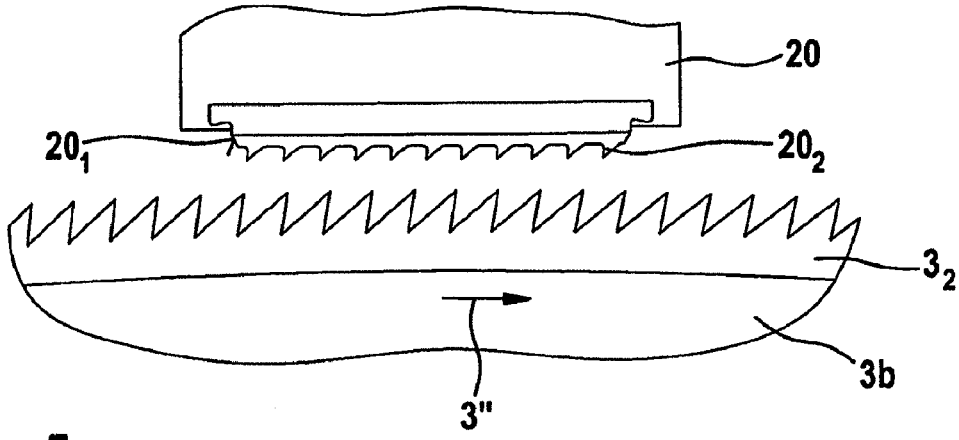
FIG. 5 shows the clothings of a fixed carding element and of an opposed roller, which clothings are located opposite one another in the carding position.

FIG. 5 shows one form of fixed carding element suitable for use as the fixed carding element 20 of FIG. 2. One or more clothing elements 20, having teeth $\mathbf{20}_2$ are mounted on a carrying element which holds the clothing elements $\mathbf{20}_1$ in opposed relationship to the clothing of roller 3*b*. As may be seen from FIG. 5, the teeth $\mathbf{20}_2$ are inclined in a direction opposite to the direction of rotation 3" of the roller 3*b*.

Figure 6:
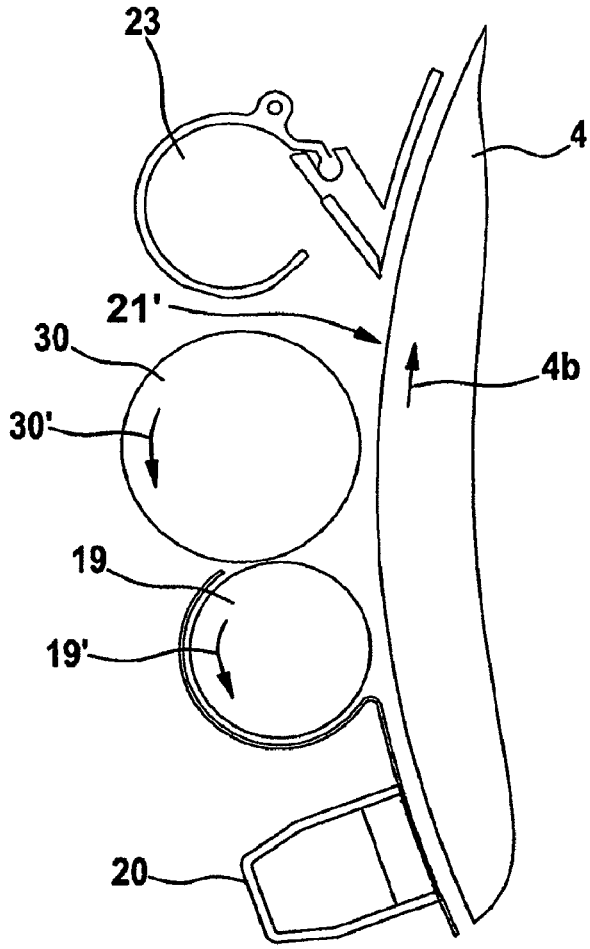
FIG. 6 is a side view of a further embodiment in which the first roller is a carding cylinder which is associated with a worker and inverter pair having a separating device.

FIG. 6 shows another embodiment of the invention in which a cleaning device is associated with the cylinder 4 of a flat card between the licker-in 3*c* and the rear card top guide roller 13*a* (see FIG. 1). In the embodiment of FIG. 6, the worker 30 rotates anti-clockwise (see arrow 30'), in the opposite direction to the cylinder 4 and in the same direction as stripper roller 19.

The invention has been explained using the example of a flat card. Its use in other machines that clean fibre material, for example, roller cards, cleaners or the like, is also included.

Although the foregoing invention has been described in detail by way of illustration and example for purposes of understanding, it will be obvious that changes and modifications may be practised within the scope of the appended claims.

What is claimed is:

1. An apparatus on a textile machine for cleaning fibre material, wherein the apparatus comprises:

a first rotating roller arranged to convey a travelling fibre web;

a second rotating roller co-operating with the first roller to form a first nip, the second roller rotating slower than the first roller;

a third rotating roller co-operating with the second roller to form a second nip and with the first roller to form a third nip, the second roller being downstream of the third roller; and a drive arrangement arranged to rotate at least one of the second and third rollers in the opposite direction to the direction of rotation of the first roller;

the arrangement being such that fibre material is opened and detached by the second roller at the first nip, and the detached fibre material is conveyed by the second roller to the second nip and is conveyed by the third roller to the third nip, where it is transferred back to the first roller; and the rollers having a clothing with clothing tips, the front surfaces of which are inclined at an acute angle in the direction of rotation, the clothing tips of the first and second rollers being inclined in different directions in the region of the first nip, and the angle of inclination of the clothing tips of the second roller being about from 10° to 50°.

2. An apparatus according to claim 1, in which the direction of rotation of the second roller is the same as the direction of rotation of the first roller.

3. An apparatus according to claim 1, in which the first roller is a carding cylinder and the second roller is a worker roller, and the direction of rotation of the second roller is opposed to the direction of rotation of the first roller and the same as the direction of rotation of the third roller.

4. An apparatus according to claim 1, in which, on transition of the fibres from the second roller to the third roller, the needles or teeth of the rollers are inclined in the same direction.

5. An apparatus according to claim 1, in which the diameter of the second roller is about from 50 to 140 mm and the diameter of the third roller is about from 60 to 90 mm.

6. An apparatus according to claim 1, in which the second roller has a rotational speed of about from 0.5 to 2 rev/mm and the third roller has a rotational speed of about from 5 to 15 rev/mm.

7. An apparatus according to claim 1, in which the circumferential speed of the third roller is higher than the speed of the second roller but lower than the speed of the first roller.

8. An apparatus according to claim 1, in which a separation opening having a width of about from 40 to 60 mm is arranged downstream—seen in the direction of rotation of the first roller—of the second roller.

9. An apparatus according to claim 1, in which fibre is able to penetrate the clothing of the second roller to at least a depth corresponding to the tooth depth.

10. An apparatus according to claim 1, in which fibre is able to penetrate the clothing of the second roller to the foot of the clothing.

11. An apparatus according to claim 1, in which the point density per square inch (ppsi) of the clothing on the second roller is not more than 140 ppsi.

12. An apparatus according to claim 1, in which the front angle of the clothing tips of the second roller is about from 40 to 50°.

13. An apparatus according to claim 1, in which the overall height of the clothing is about from 4 to 5 mm.

14. An apparatus according to claim 1, in which the first roller is a licker-in of a flat card or roller card.

15. An apparatus according to claim 1, in which the first roller is a carding cylinder of a flat card or roller card.

16. An apparatus on a flat card, roller card or the like for cleaning fibre material comprising a high-speed first or main roller, which is adapted to support or convey a travelling fibre web, associated second and third rollers, which have respective nips with one another and with the first roller on rotation of the three rollers, and drive means for rotation of the rollers, which drive means are so arranged that the second roller is rotated in a direction of rotation that is the same as that of the first roller and opposite to that of the third roller, wherein the second roller is arranged downstream of the third roller and so co-operates with the first roller that a fibre mat is opened and detached, the fibre mat is transferred to the nip with the third roller and is conveyed by the third roller to the nip with the first roller, where it is transferred back to the first roller, the rollers having a clothing with needles or teeth which are inclined at an acute angle (front angle) in the direction of rotation, and in the region of the transition of the fibres from the first roller to the second roller the needles or teeth of the rollers in question being inclined in different directions and the speed of the second roller being low in comparison with the speed of the first roller, wherein the front angle is about from 10° to 50°.

* * * * *